US008585102B2

(12) United States Patent
Gottschling

(10) Patent No.: US 8,585,102 B2
(45) Date of Patent: Nov. 19, 2013

(54) COMPRESSION CLOSURE

(75) Inventor: Reinhard Gottschling, Essen (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 462 days.

(21) Appl. No.: 12/682,164

(22) PCT Filed: Aug. 28, 2008

(86) PCT No.: PCT/EP2008/007038

§ 371 (c)(1),
(2), (4) Date: May 20, 2010

(87) PCT Pub. No.: WO2009/049712

PCT Pub. Date: Apr. 23, 2009

(65) Prior Publication Data

US 2010/0244462 A1 Sep. 30, 2010

(30) Foreign Application Priority Data

Oct. 9, 2007 (DE) ..... 20 2007 014 082 U

(51) Int. Cl.

| | |
|---|---|
| ***E05C 5/04*** | (2006.01) |
| ***E05C 7/00*** | (2006.01) |
| ***E05C 19/04*** | (2006.01) |
| ***E05C 3/02*** | (2006.01) |
| ***E05C 3/06*** | (2006.01) |
| ***E05C 5/02*** | (2006.01) |
| ***E05C 5/00*** | (2006.01) |
| ***E05C 19/00*** | (2006.01) |

(52) U.S. Cl.

USPC ..... 292/58; 292/12; 292/15; 292/23; 292/194; 292/197; 292/198; 292/280; 292/63; 292/57

(58) Field of Classification Search

USPC ..... 292/1, 12, 15, 23, 63, 64, 67, 194, 195, 292/197, 198, 199, 200, 280, DIG. 68; 312/331, 319.2; 70/386, 379 R, 379 A, 70/380, 190, 135, 136, 137, 138, 139

See application file for complete search history.

(56) References Cited

U.S. PATENT DOCUMENTS 84,098 A * 11/1868 Edson ..... 292/197
171,694 A * 1/1876 Payson ..... 292/194

(Continued)

FOREIGN PATENT DOCUMENTS

DE 20 2004 003707 7/2005
EP 1 131 521 9/2001

(Continued)

*Primary Examiner* — Thomas Beach
*Assistant Examiner* — Edwin Toledo-Duran
(74) *Attorney, Agent, or Firm* — Frommer Lawrence & Haug LLP

(57) ABSTRACT

A compression latch comprises a latch housing with a driving end and a driven end and with a drive shaft which is rotatably supported between these ends and which has a driving device such as a socket wrench receptacle or gearing at the driving end of the latch housing. The latch housing, at the driven end, forms an annular surface around the axis of the drive shaft. According to the invention, the drive shaft has, at the driven end of the latch housing, a bearing journal whose axis has an angle of approximately 45 degrees relative to the axis of the drive shaft, and the base of a rotary latch is supported on the bearing journal, this base (30) forming an annular surface around the axis of the bearing journal, and two annular surfaces roll on one another by frictional engagement or positive engagement when the drive shaft is rotated.

12 Claims, 19 Drawing Sheets

(56) References Cited

U.S. PATENT DOCUMENTS

| | | | | | |
|---|---|---|---|---|---|
| 366,756 | A | * | 7/1887 | Barnes | 292/58 |
| 676,779 | A | * | 6/1901 | Stahl | 292/199 |
| 708,097 | A | * | 9/1902 | Tower | 292/199 |
| 1,186,449 | A | * | 6/1916 | Smith | 292/63 |
| 1,221,933 | A | * | 4/1917 | White | 292/198 |
| 1,394,357 | A | * | 10/1921 | Rose | 70/190 |
| 1,642,512 | A | * | 9/1927 | Schrader | 292/332 |
| 2,493,882 | A | * | 1/1950 | Lambert | 292/48 |
| 2,610,079 | A | * | 9/1952 | Lambert | 292/196 |
| 2,650,492 | A | * | 9/1953 | Jacobi | 70/490 |
| 2,750,788 | A | * | 6/1956 | Jacobi | 70/379 R |
| 4,807,914 | A | * | 2/1989 | Fleming et al. | 292/48 |
| 4,898,408 | A | * | 2/1990 | Hauber | 292/7 |
| 5,409,272 | A | * | 4/1995 | McCormack | 292/66 |
| 5,509,703 | A | * | 4/1996 | Lau et al. | 292/1 |
| 5,938,248 | A | * | 8/1999 | Vickers et al. | 292/36 |
| 6,123,370 | A | * | 9/2000 | Rozema et al. | 292/47 |
| 6,152,497 | A | * | 11/2000 | Vickers et al. | 292/34 |
| 7,360,802 | B2 | * | 4/2008 | Schlack et al. | 292/75 |
| 7,695,029 | B2 | * | 4/2010 | Ramsauer | 292/67 |
| 8,181,393 | B2 | * | 5/2012 | Talpe | 49/394 |
| 2010/0107803 | A1 | * | 5/2010 | Ramsauer et al. | 74/510 |

FOREIGN PATENT DOCUMENTS

| | | |
|---|---|---|
| WO | WO 99/14458 | 3/1999 |
| WO | WO 00/49251 | 8/2000 |

* cited by examiner

Fig. 5C
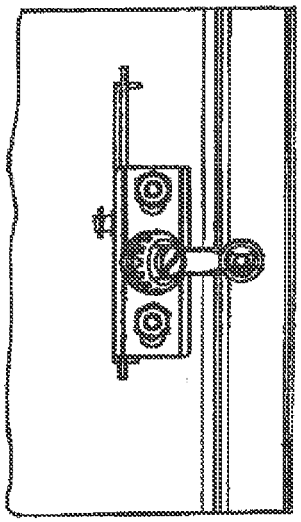
Fig. 5D
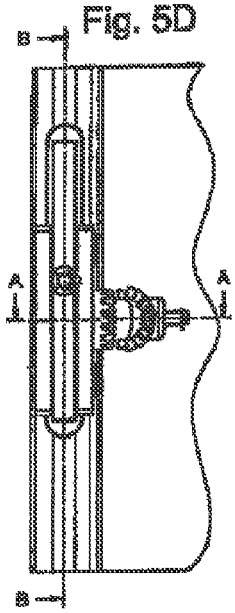
Fig. 5G
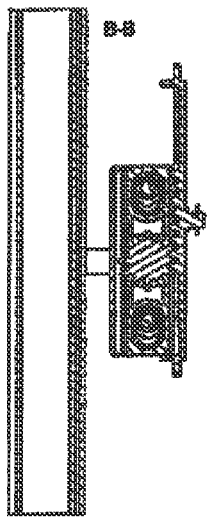
Fig. 5E
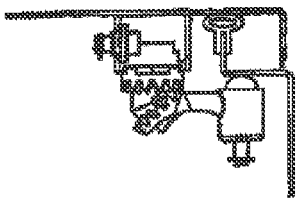
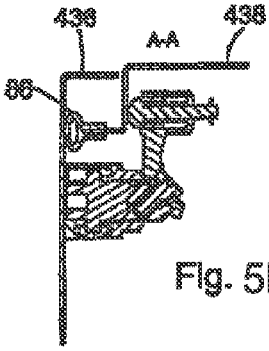
Fig. 5F

COMPRESSION CLOSURE

The present application claims priority from PCT Patent Application No. PCT/EP2008/007038 filed on Aug. 28, 2008, which claims priority from German Patent Application No. DE 20 2007 014 082.7 filed on Oct. 9, 2007, the disclosure of which is incorporated herein by reference in its entirety.

BACKGROUND OF THE INVENTION

1. Field of the Invention

The invention is directed to a compression latch comprising a latch housing with a driving end and a driven end and with a drive shaft which is rotatably supported between these ends and which has a driving device such as a socket wrench receptacle or gearing at the driving end of the housing, and which housing at the driving end forms an annular surface around the axis of the drive shaft.

2. Description of Related Art

A compression latch of the type mentioned above is already known from EP 1 131 521 B1 (see, for example, FIG. 1 of the cited publication).

SUMMARY OF THE INVENTION

It is the object of the invention to provide a compression latch of the type mentioned above which offers another alternative to the construction of the known latch.

The above-stated object is met in that the drive shaft at the driven end of the housing has a bearing journal whose axis has an angle of approximately 45 degrees relative to the axis of the drive shaft and in that the base of a rotary latch is supported on the bearing journal, this base forming an annular surface around the axis of the bearing journal, and two annular surfaces roll on one another by frictional engagement or positive engagement when the drive shaft is rotated.

The compression latch has the advantage that it makes possible a relatively large range of compression depending on the length of the rotary latch.

According to a further development of the invention, a bar proceeds from the base and extends at an angle of approximately 45 degrees with respect to the plane of the annular surface of the base.

According to another construction of the invention, the positive-engaging rolling is achieved by means of a toothing of the annular surfaces, preferably having the same number of teeth on the annular surfaces. The positive-engaging connection has the advantage of greater stability.

The housing can have various shapes. According to a further development of the invention, the housing has a rectangular lock case. In another construction, the housing is a substantially round rotary latch housing. The free end of the rotary latch can form a contact tongue. Alternatively, the free end of the rotary latch can have a contact roller, which is especially advantageous for producing the force required for rotating the bar.

According to another embodiment form, the free end of the rotary latch forms a spring-loaded partially spherical surface.

According to another construction of the invention, the bearing journal is formed by a head screw.

However, the bearing journal can also be formed by a shoulder which is formed integral with the drive shaft and has a retaining ring at the free end.

The lock case can guide a toothed rack which meshes with a toothed wheel connected to the driveshaft so as to be fixed with respect to rotation relative to it.

The rotary latch can have an adjusting joint between the base and the contact surface.

Finally, it is possible to construct the rotary latch so as to be bent between the base and contact surface.

BRIEF DESCRIPTION OF THE DRAWINGS

FIGS. 5A to 5G show corresponding views of another construction of the compression latch according to the invention.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1B:
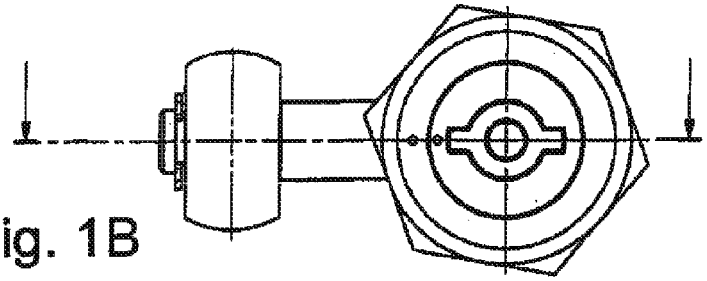
FIG. 1B shows a top view of the compression latch according to FIG. 1A.
Figure 1A:
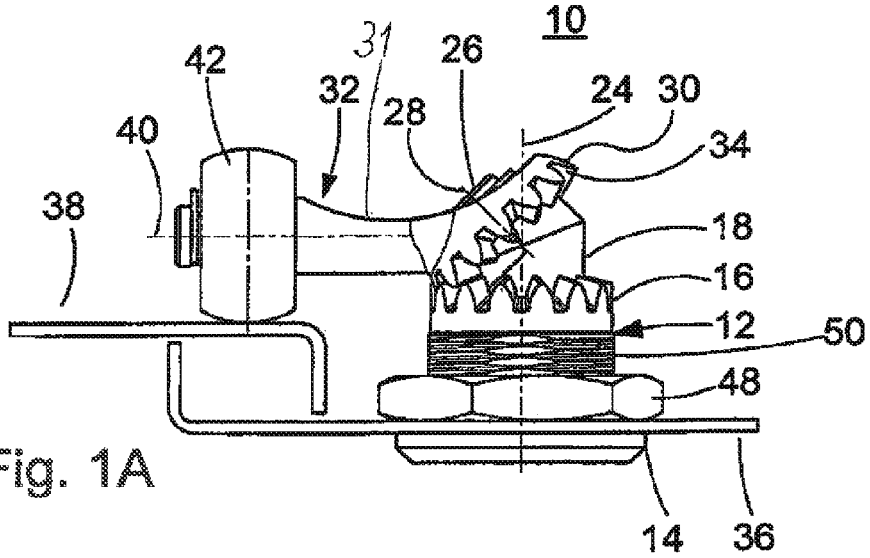
FIG. 1A shows a side view of a compression latch according to the invention installed at the door leaf in the closed position.
Figure 1C:
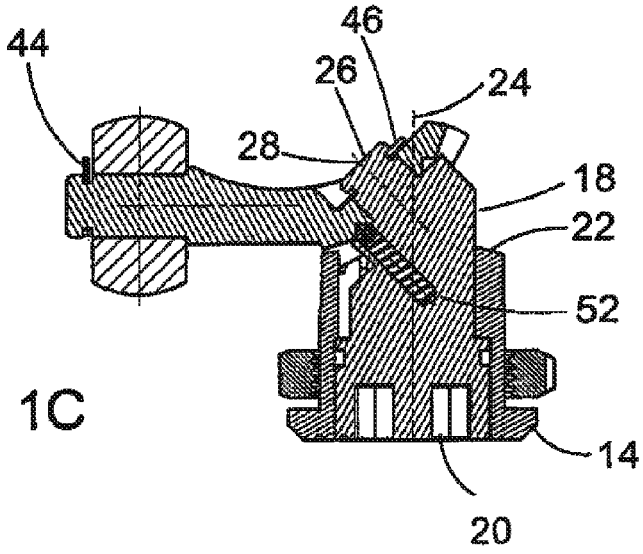
FIG. 1C shows an axial sectional view through the latch according to FIG. 1B along section line A-A.
Figure 1D:
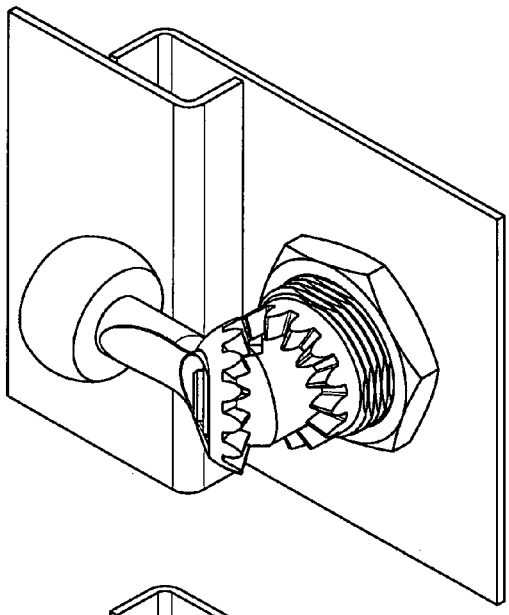
FIG. 1D shows the latch according to FIG. 1A in a perspective view in the closed position.
Figure 1H:
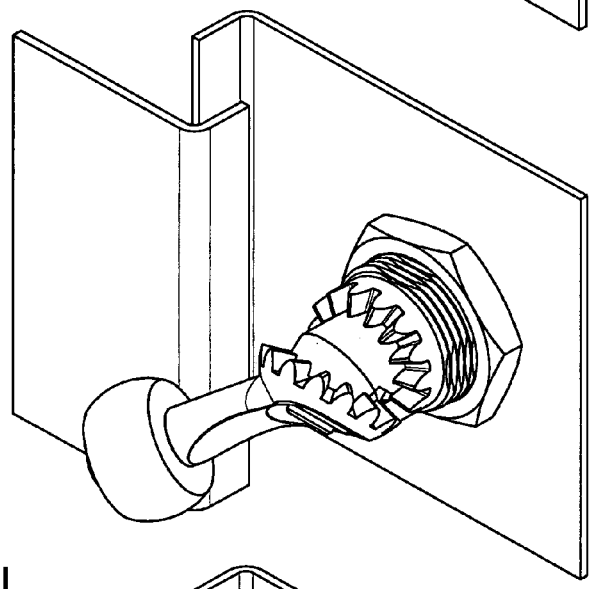
FIGS. 1E to 1H show corresponding views of the latch from FIG. 1A, but in the half-opened position.
Figure 1L:
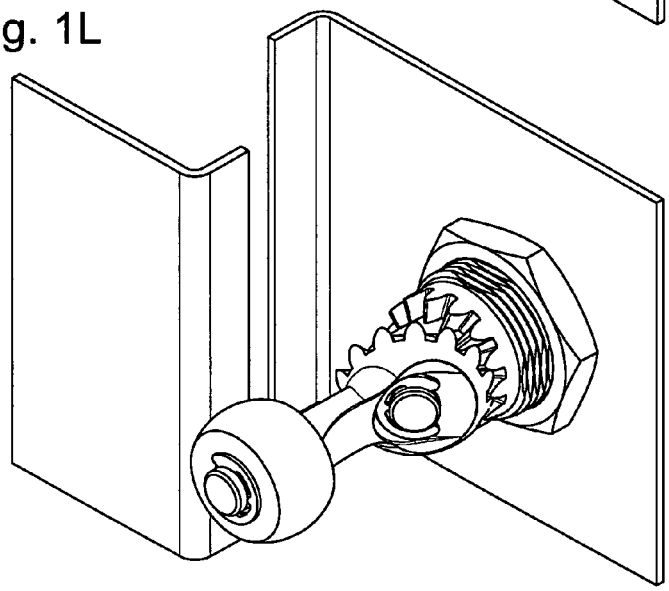
FIGS. 1J to 1L show corresponding views of the latch according to FIG. 1A, but in the fully opened position.
Figure 1F:
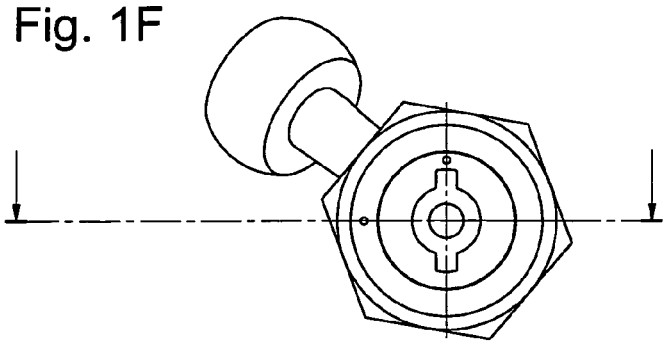
Figure 1E:
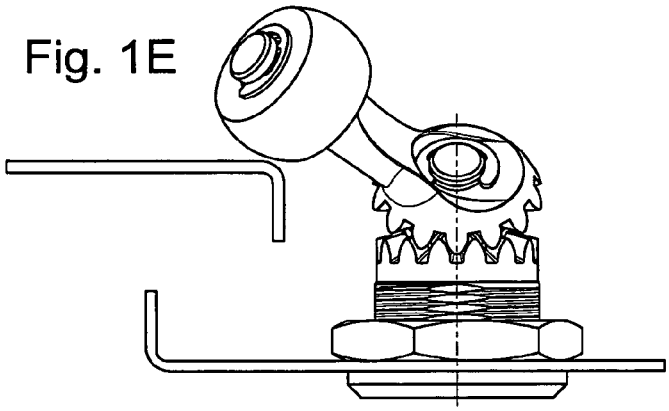
Figure 1G:
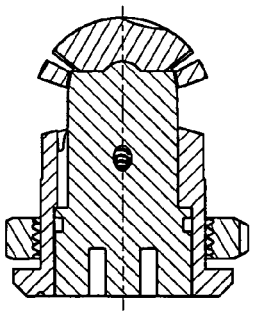

FIG. 1A shows a compression latch 10 comprising a latch housing 12 with a driving end 14 and a driven end 16 and with a drive shaft 18 which is rotatably supported between these ends 14, 16 and which has a driving device 20 such as a socket wrench receptacle or gearing at the driving end 14 of the housing 12. The housing 12 at the driven end 16 forms an annular surface 22 around the axis 24 of the drive shaft 18. The drive shaft 18 has, at the driven end 16 of the housing 12, a bearing journal 26 having an angle of approximately 45 degrees relative to the axis 24 of the drive shaft 18. The base 30 of a rotary latch 32 is supported on the bearing journal 26, this base 30 forming an annular surface 34 around the axis 28 of the bearing journal 26. Two annular surfaces 16, 34 roll on one another by frictional engagement or, preferably, positive engagement when the drive shaft 18 is rotated. In the present embodiment form, the housing 12 is secured in a door leaf 36 in a conventional manner by a screw closure, while the rotary latch 32 engages behind a frame 38. As can be seen, a bar 31 projects from the base 30. The bar extends at an angle of approximately 45 degrees with respect to the plane of the annular surface of the base 30. Owing to this angular ratio, the position of the bar 31, particularly its axis 40, changes. While the axis 40 extends parallel to the plane of the door leaf plane 36 (angle of 0 degrees) in the base position shown in FIGS. 1A, 1B and 1C, the angle has increased to about 45 degrees in the half-open position shown in FIGS. 1D, 1E and 1F, so that the cabinet door and cabinet frame can be moved away from one another.

Figure 1J:
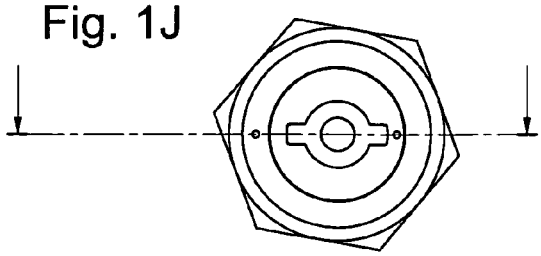
Figure 1I:
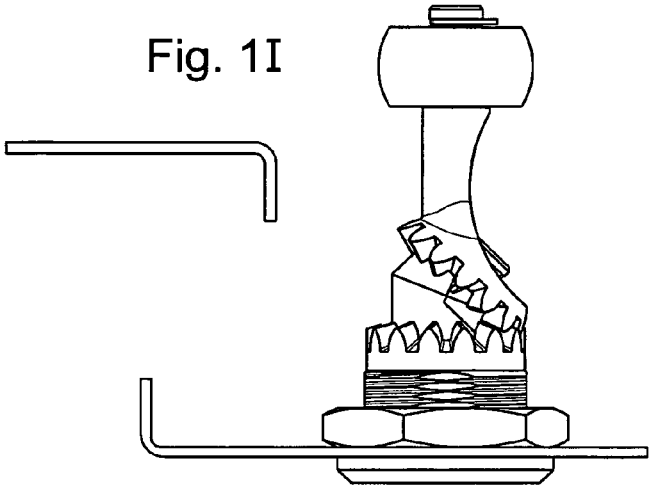
Figure 1K:
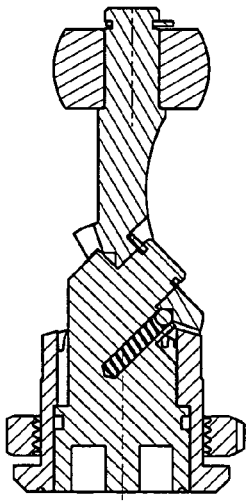

Finally, in the view shown in FIGS. 1I to 1K, the angle reaches 90 degrees so that the door leaf comes away from the door frame completely.

During this rotating and pivoting movement of the bar 31, the shaft 18 rotates by 180 degrees which corresponds exactly to a half-revolution.

A positive-engaging rolling is realized in all of the embodiment forms shown in the drawings, namely, by means of a toothing of the annular surfaces 18, 34. The two annular surfaces preferably have the same diameter and the same number of teeth.

Figure 6:
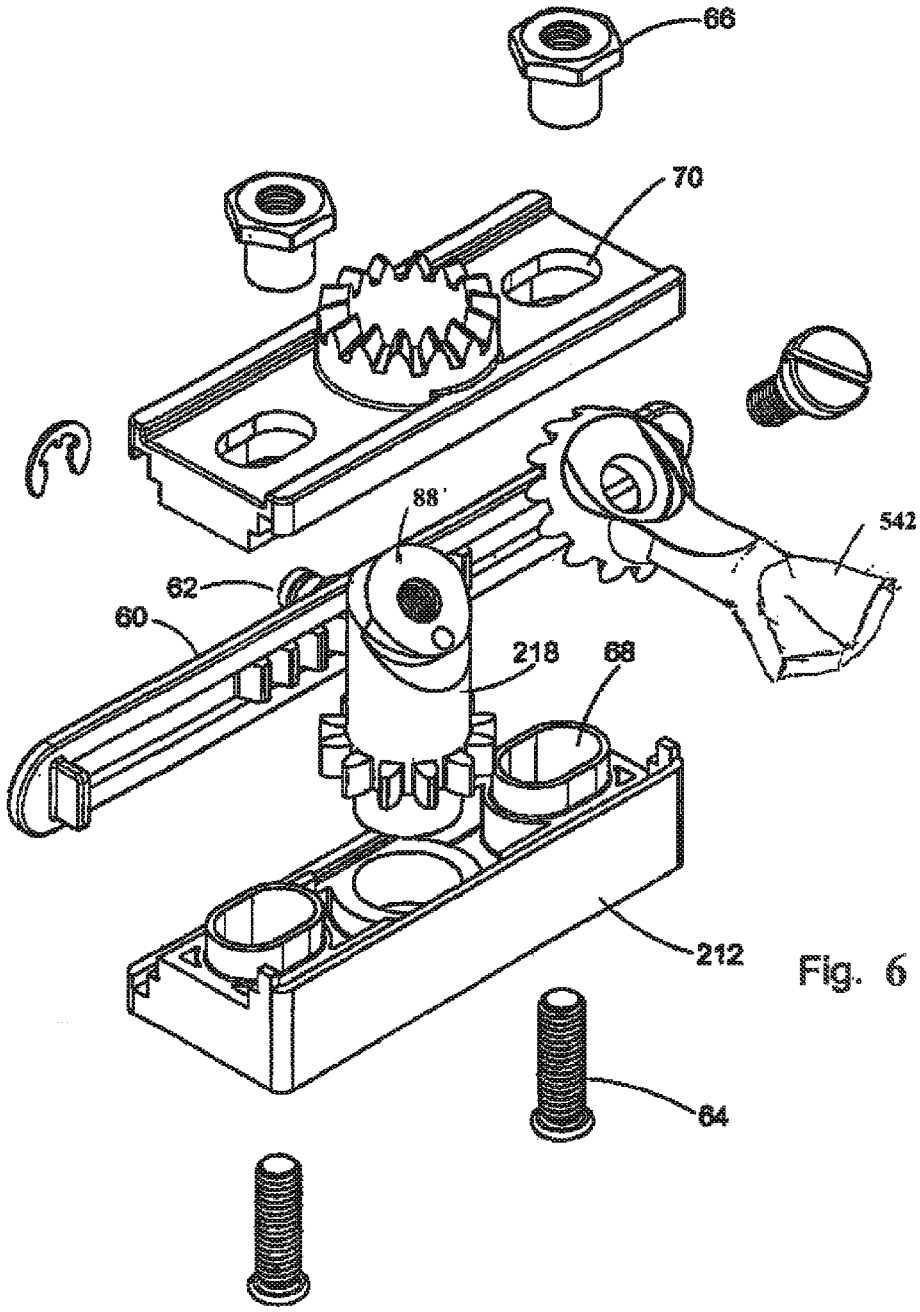
FIG. 6 another construction of the compression latch according to the invention.

In the embodiment forms shown in FIGS. 1A to 1K, the free end of the rotary latch 32 has a contact roller 42. This has the advantage of reduced friction compared to the contact tongue 542, shown in FIG. 6, and accordingly contributes to the smoothness of the latch operation. The contact roller 42 is held by a retaining ring 44. The base 30 is likewise held on the bearing journal 26 by a retaining ring 46. The construction is designed in such a way that the latch can be fastened by a union nut 48 which can be fitted along the bar and can be screwed onto a circumferential thread 50 of the housing (see FIG. 1A).

A pin or set screw 52 serves as a stop for the movement of the base and, therefore, of the bar.

FIGS. 2A to 2H show embodiment forms in which the compression element is constructed as a shoulder at a conventional rotary latch. In other respects, the operation is the same as that described above.

Figure 2A:
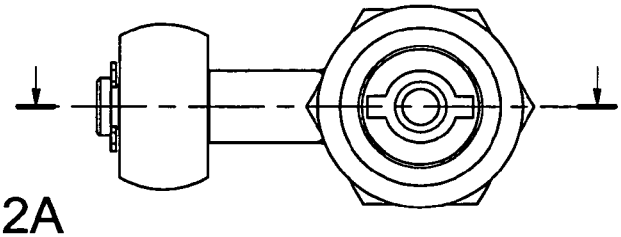
FIG. 2A shows a top view along line C-C from FIG. 2A of a compression latch according to the invention with an adapter, by which the latch can be linked with a conventional rotary latch housing, in the closed position.
Figure 2B:
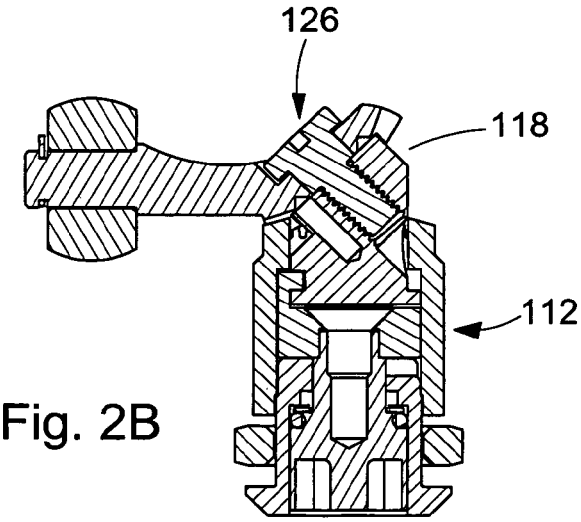
FIG. 2B shows an axial sectional view along line C-C from FIG. 2A of a compression latch according to the invention with an adapter, by which the latch can be linked with a conventional rotary latch housing, in the closed position.
Figure 2C:
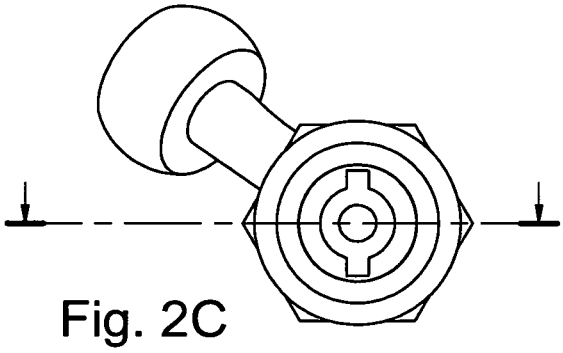
FIGS. 2C and 2D show corresponding views of the latch, but in the half-opened position.
Figure 2D:
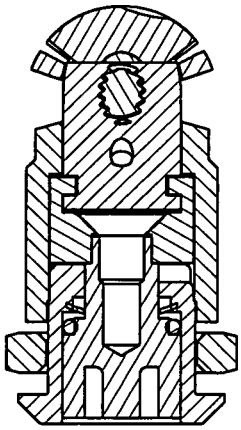
Figure 2E:
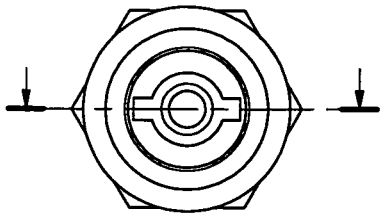
FIGS. 2E and 2F show corresponding views, but with fully opened latch.
Figure 2F:
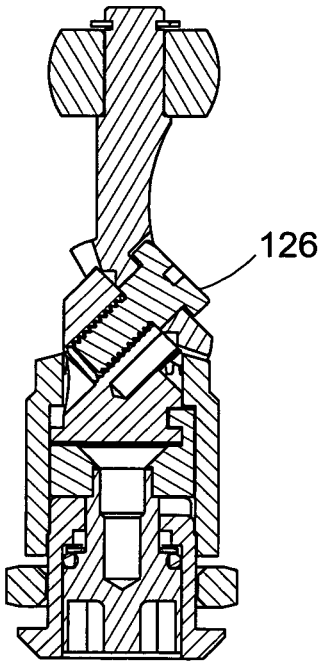
Figure 2G:
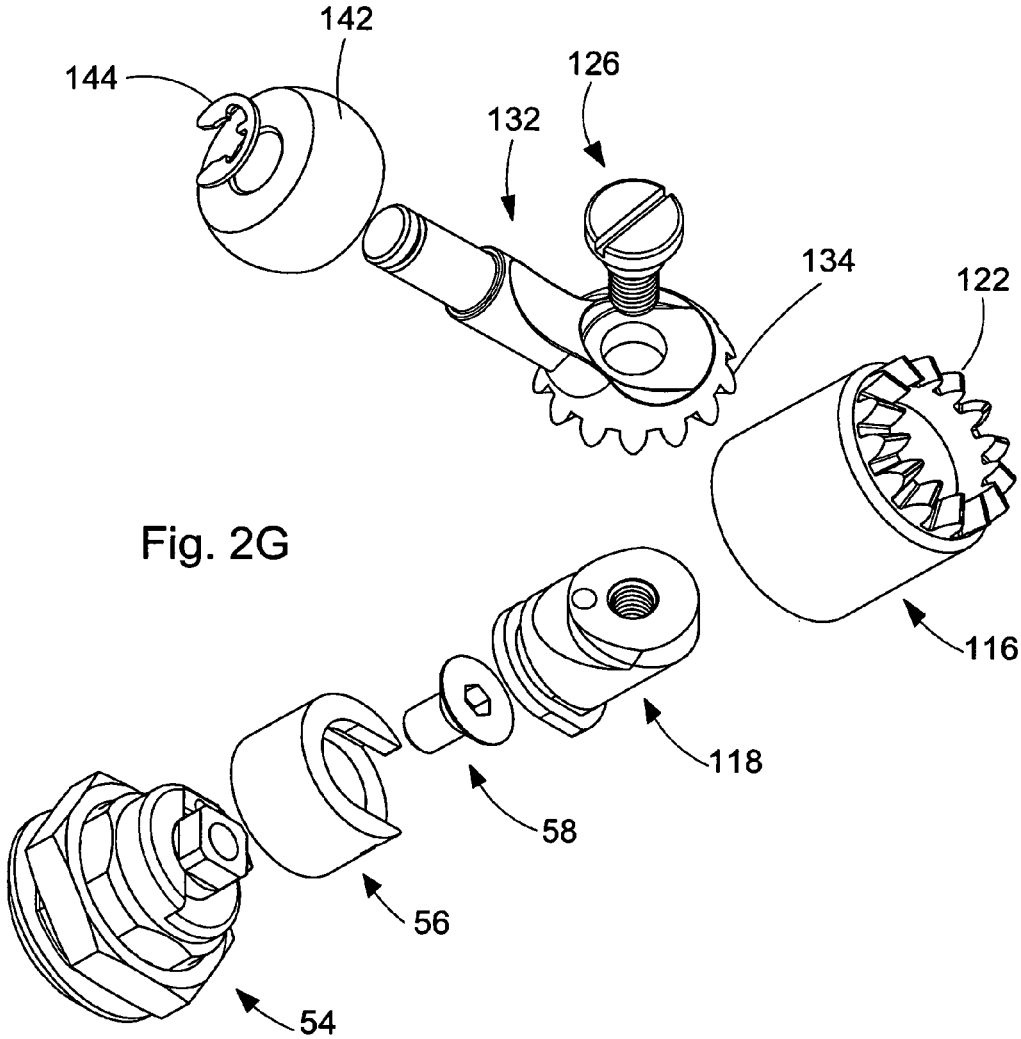
FIGS. 2G and 2H show the latch from FIG. 2A in a perspective, exploded view from two different viewing angles.
Figure 2H:
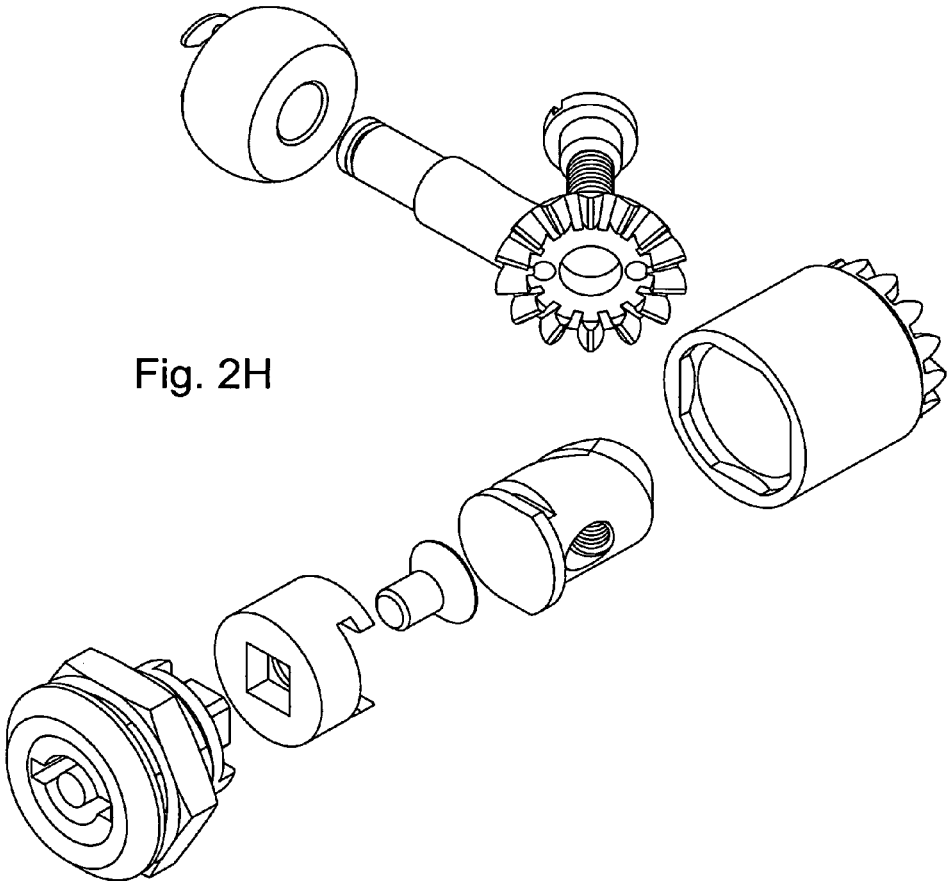

Further, in contrast to the embodiment form already described in which the bearing journal 26 is formed by a shoulder which is integral with the drive shaft 22 and which has a retaining ring at the free end, a head screw forms the bearing journal 126 in this case. FIG. 2G shows the individual parts comprising a conventional latch from which the tongue has been removed (see reference number 54). Instead of the tongue, an adapter piece 56 is fitted by means of a socket head screw 58 in which a driveshaft 118 can be inserted laterally. These structural component parts 56, 58 are rotatable for the bearing support of the housing part 116.

Figure 3A:
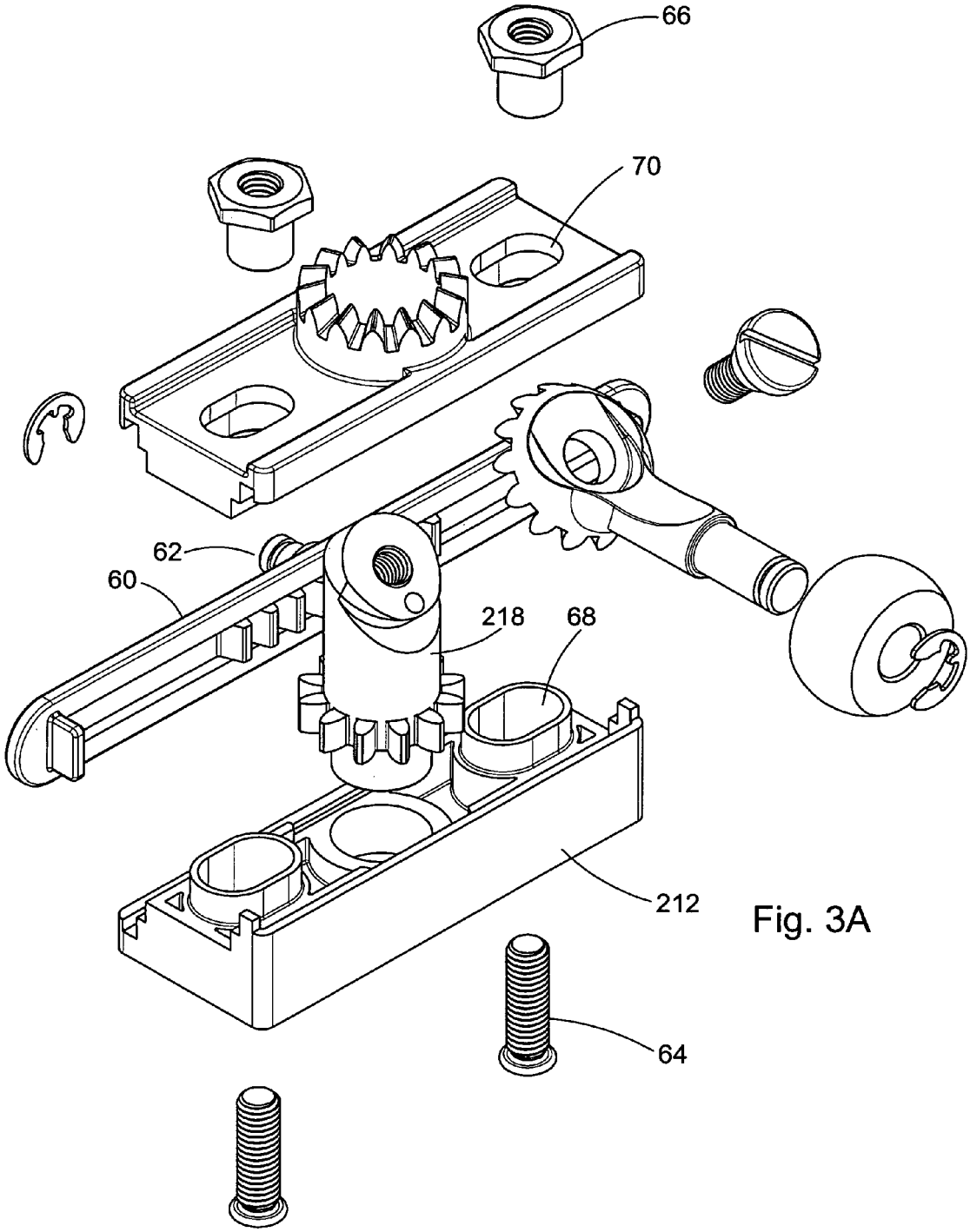
FIG. 3A shows an exploded view of a compression latch according to the invention accommodated in a rectangular lock case.
Figure 3B:
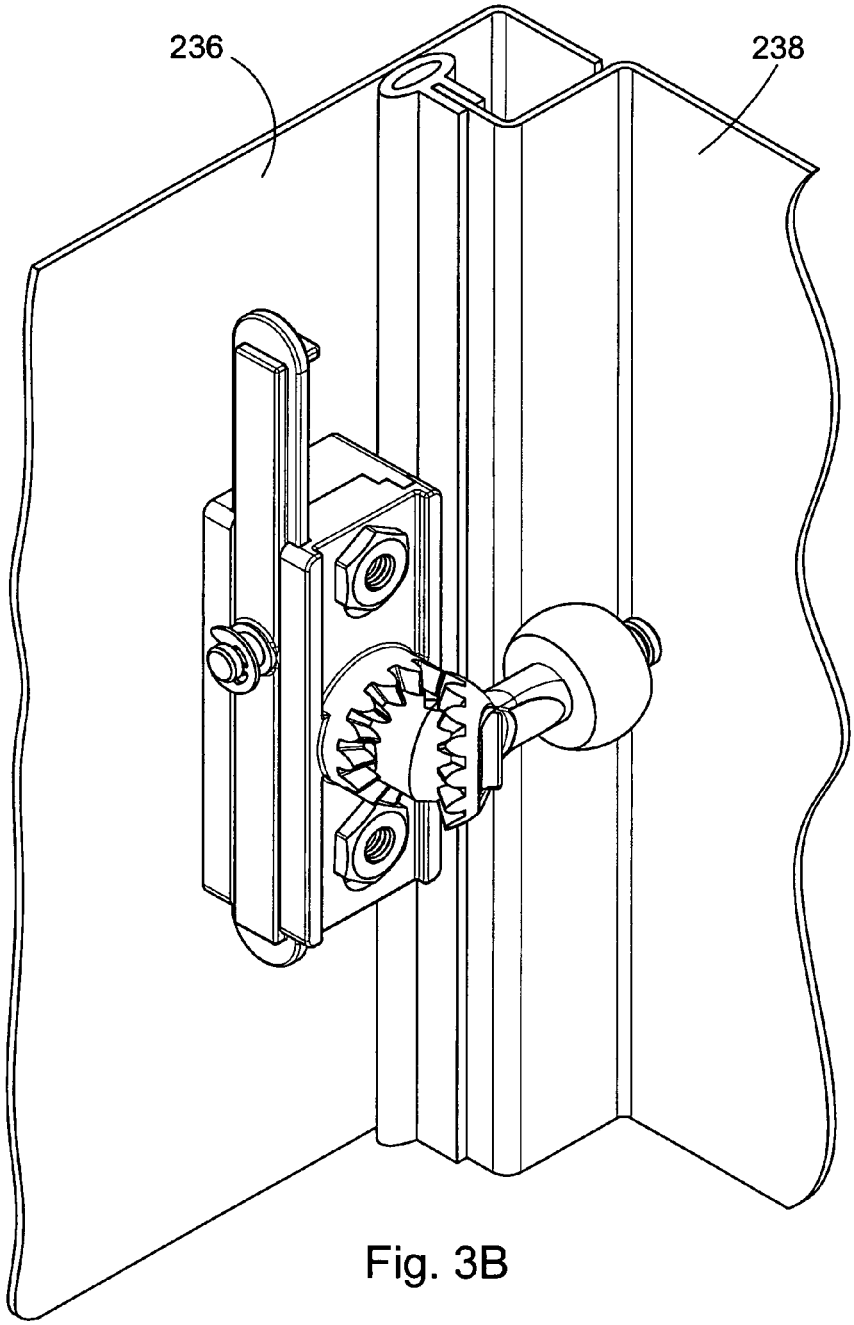
FIG. 3B shows the assembled latch from FIG. 3A in the closed position.
Figure 3C:
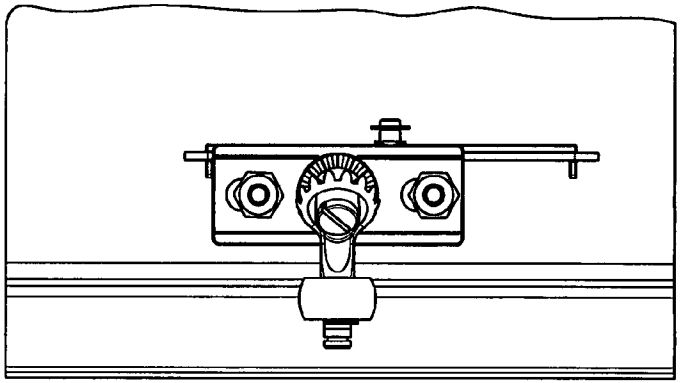
FIGS. 3C, 3D and 3E show three different views of the latch from FIG. 3B.
Figure 3D:
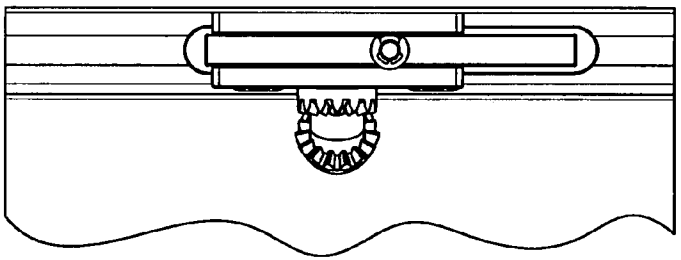
Figure 3E:
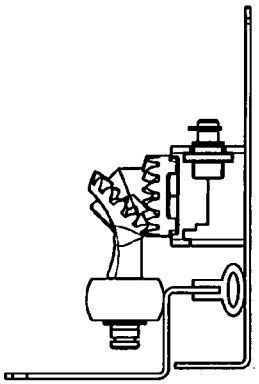
Figure 4A:
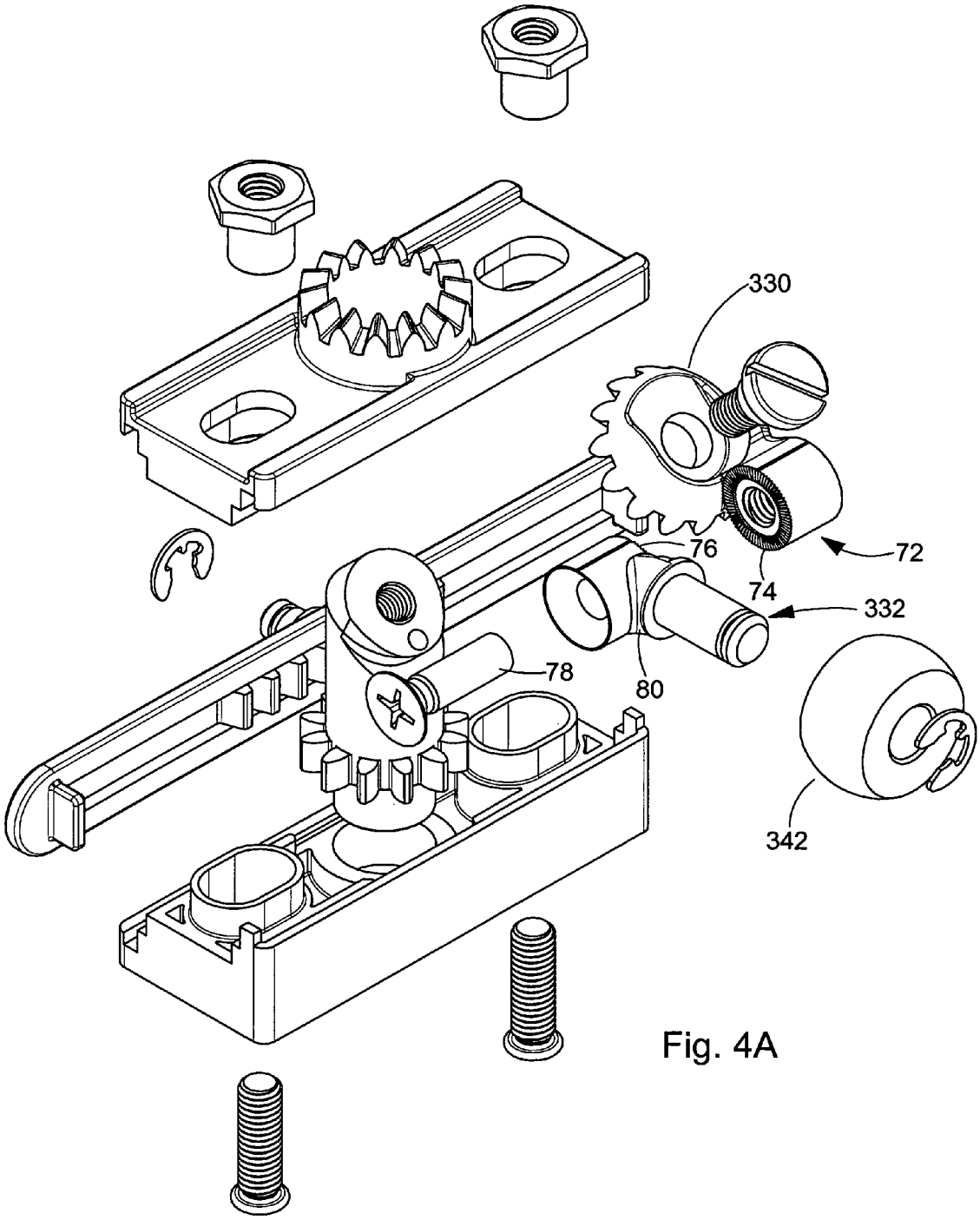
FIGS. 4A to 4E show views similar to FIGS. 3A to 3E showing a latch with modified embodiment form in which a rotary latch is arranged between the base and the roller.
Figure 4B:
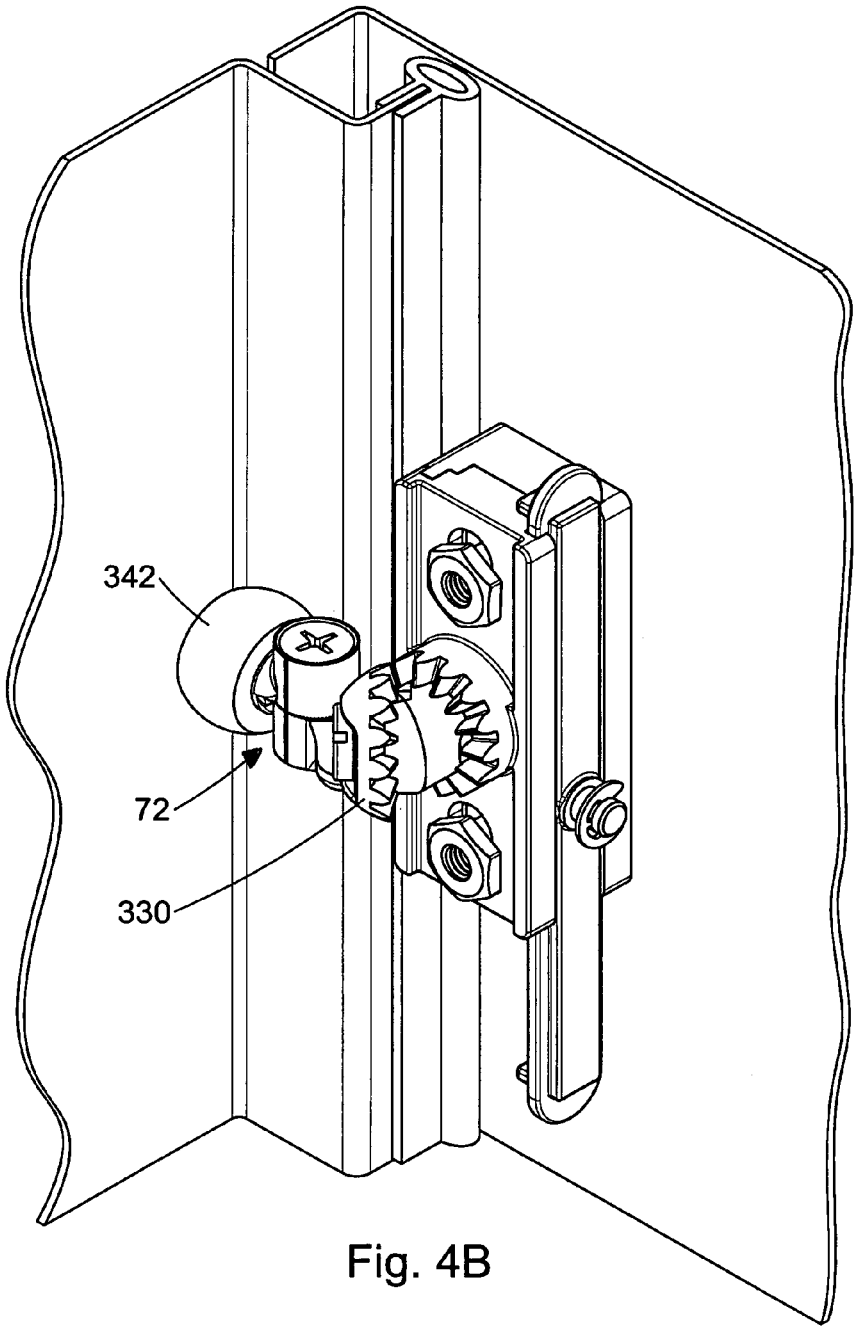
Figure 4D:
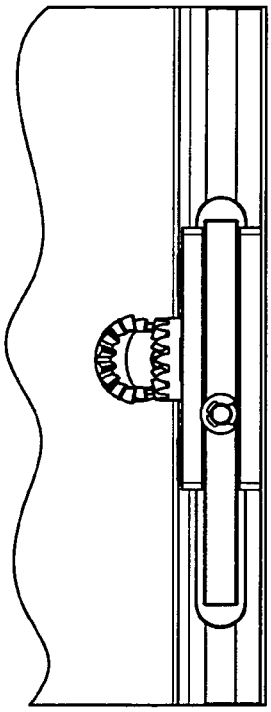
Figure 4C:
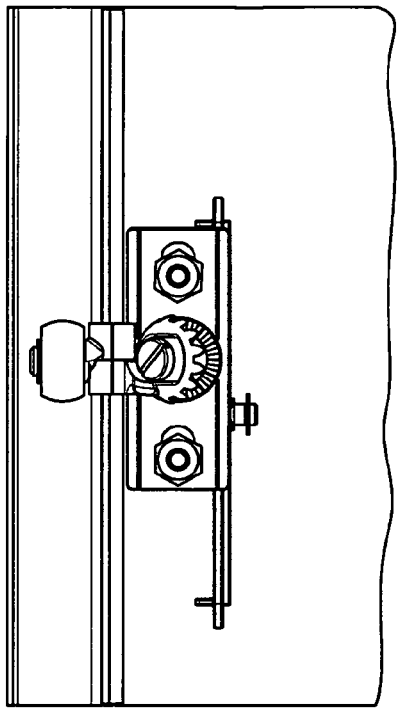
Figure 4E:
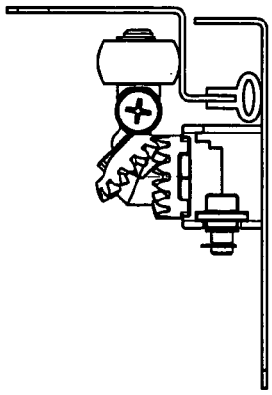
Figure 5A:
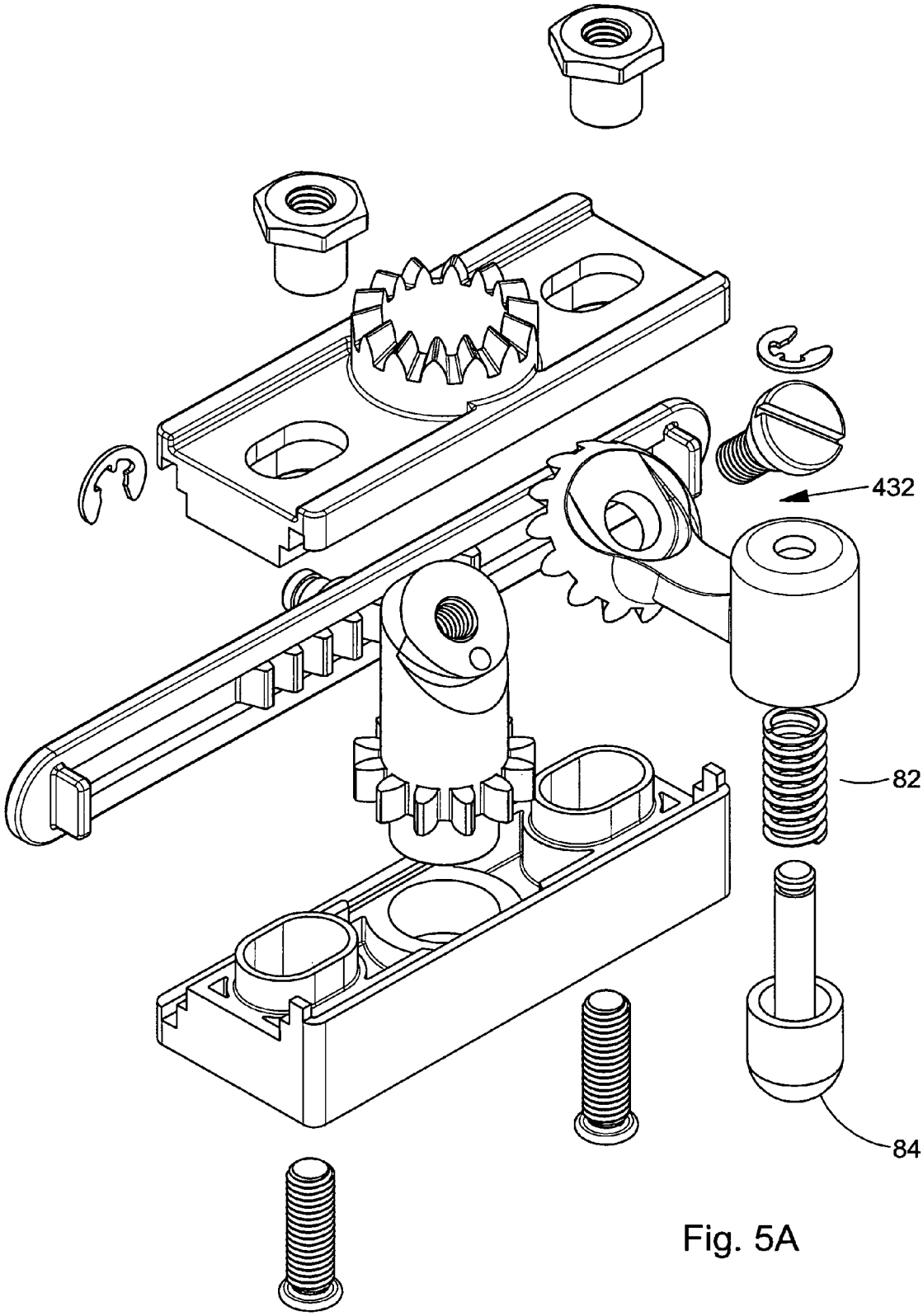
Figure 5B:
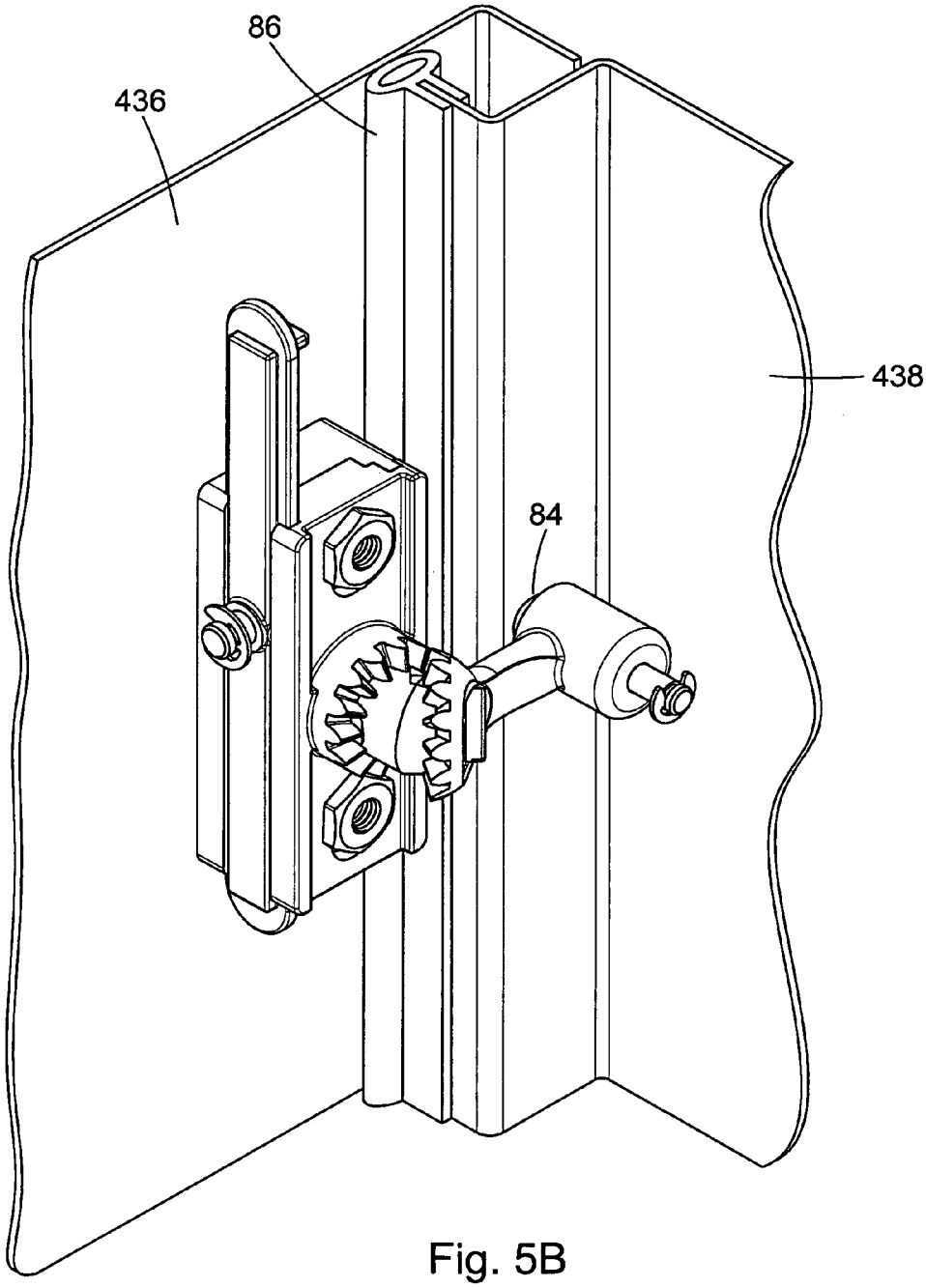

In the embodiment form according to FIGS. 3A to 3E, the housing is a rectangular lock case 212. The drive shaft 218 has at its lower end a toothed wheel which is supported in the lock case which meshes with the displaceable toothed rack 60 that is likewise supported in the lock case 212. The toothed rack can drive a locking bar, not shown, by means of the driver 62. As can be seen in FIG. 3A, the two parts of the lock housing 212 are held together by screws 64 and nuts 66 and are also optionally fastened to the door leaf 236. The drive shaft 218 can be driven either by the toothed rack 60 or by a socket wrench or by a swivel lever latch, or the like, depending on the desired combination of fittings.

The screws 64 and the associated nuts 66 are guided in openings 68, 70 of the lock case halves in such a way that a certain adjustability is provided in direction of the toothed rack so that the zero position of the rotary latch can be adjusted with respect to the locking bar which is articulated at the toothed rack. Further adjustment possibilities, particularly with respect to the tightness of the latch in the closed position, can be realized according to the embodiment form shown in FIGS. 4A to 4E when the rotary latch 332 has a joint 72 between the base 330 and the contact surface 342, which joint 72 comprises two grooved or ribbed surfaces 74, 76 which make it possible after adjusting the tightness by means of a screw to fix this adjustment.

The rotary latch 332 is bent (see reference number 80) in order to keep the loading of the base surface 330 exactly on the axial point.

In the embodiment form according to FIGS. 5A to 5G, the free end of the rotary latch 432 forms a spring-loaded (reference number 82) partially spherical surface 84. This results in a self-adjusting H-gauge (i.e., for measuring the pressure applied on the seal 86 between the door and frame).

COMMERCIAL APPLICABILITY

The invention is commercially applicable in switch cabinet construction.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

REFERENCE NUMBERS

10 compression latch
12, 112, 212 latch housing
14 driving end
16, 116 driven end
18, 118, 218 drive shaft
20 driving device
22, 122 annular surface of the housing
24 axis of the drive shaft
26, 126 bearing journal
28 axis of the bearing journal
30, 330 base
32, 132, 332, 432 rotary latch
31 bar
34, 134 annular surface of the base
36, 236, 436 door leaf
38, 238, 438 frame
40 axis of the bar
42, 142, 342 contact roller
44, 144 retaining ring
46 retaining ring

48 union nut
50 circumferential thread
52 stop pin
54 sash-type lock without tongue
56 adapter
58 screw
60 toothed rack
62 driver
64 screw
66 nut
68 opening
70 opening
72 joint
74 ribbed surface
76 ribbed surface
78 screw
80 bend
82 spring
84 partially spherical surface
86 seal

The invention claimed is:

1. A compression closure comprising:

A latch housing with a driving end and a driven end, and with a drive shaft which is rotatably supported between these ends; and a driving device at the driving end of the latch housing;

wherein the latch housing, at the driven end, forms an annular surface around the axis of the drive shaft;

wherein the drive shaft has, at the driven end of the latch housing, a bearing journal whose axis has an angle of approximately 45 degrees relative to the axis of the drive shaft;

wherein a base of a rotary latch is supported on the bearing journal, the base forming an annular surface around the axis of the bearing journal;

wherein the free end of the rotary latch forms a contact tongue or has a contact roller or has a spring-loaded partially spherical surface; and wherein the two annular surfaces roll on one another by frictional engagement or positive engagement by means of a toothing of the annular surfaces when the drive shaft is rotated.

2. The compression closure according to claim 1;

wherein a bar proceeds from the base and extends at an angle of approximately 45 degrees with respect to the plane of the annular surface of the base.

3. The compression closure according to claim 1;

wherein the latch housing has a rectangular lock case.

4. The compression closure according to claim 1;

wherein the latch housing is a substantially round rotary latch housing.

5. The compression closure according to claim 1;

wherein the free end of the rotary latch forms the contact tongue.

6. The compression closure according to claim 1;

wherein the free end of the rotary latch has the contact roller.

7. The compression closure according to claim 1; wherein the free end of the rotary latch has the spring-loaded partially spherical surface.

8. The compression closure according to claim 1;

wherein the bearing journal is formed by a head screw.

9. The compression closure according to claim 1;

wherein the bearing journal is formed by a shoulder which is formed integral with the drive shaft and has a retaining ring at the free end.

10. The compression closure according to claim 3;

wherein the lock housing guides a toothed rack which meshes with a toothed wheel connected to the driveshaft so as to be fixed with respect to rotation relative to it.

11. The compression closure according to claim 1;

wherein the rotary latch has an adjusting joint between the base and the contact surface.

12. The compression closure according to claim 1;

wherein the rotary latch is bent between the base and the contact surface.

* * * * *